US005889812A

United States Patent [19]

Schluckebier

[11] Patent Number: 5,889,812

[45] Date of Patent: Mar. 30, 1999

[54] PROCESS FOR THE OPERATION OF CORELESS INDUCTION MELTING FURNACES OR HOLDING FURNANCES AND AN ELECTRICAL SWITCHING UNIT SUITABLE FOR THE SAME

[75] Inventor: Dieter Schluckebier, Simmerath, Germany

[73] Assignee: Otto Junker GmbH, Germany

[21] Appl. No.: 693,147

[22] PCT Filed: Feb. 10, 1995

[86] PCT No.: PCT/DE95/00175

§ 371 Date: Oct. 7, 1996

§ 102(e) Date: Oct. 7, 1996

[87] PCT Pub. No.: WO95/22238

PCT Pub. Date: Aug. 17, 1995

[30] Foreign Application Priority Data

Feb. 11, 1994 [DE] Germany ..... 44 04 412.7

[51] Int. Cl.[6] ..... H05B 6/06

[52] U.S. Cl. ..... 373/149; 373/146; 373/148; 373/151; 363/71

[58] Field of Search ..... 373/139, 146, 373/147, 148, 149, 150, 151, 152, 156; 363/71; 323/346

[56] References Cited

U.S. PATENT DOCUMENTS

| | | | |
|---|---|---|---|
| 1,286,393 | 12/1918 | Northrup | 373/146 |
| 1,822,539 | 9/1931 | Northrup | 373/146 |
| 1,852,215 | 4/1932 | Northrup | 373/146 |
| 1,940,622 | 12/1933 | Clamer | 373/146 |
| 1,943,802 | 1/1934 | Northrup | 373/146 |
| 3,314,670 | 4/1967 | Kennedy | 373/148 |
| 3,382,311 | 5/1968 | Rydinger et al. | 373/146 |
| 3,478,156 | 11/1969 | Segsworth | 373/146 |
| 3,536,983 | 10/1970 | Kennedy | 373/146 |
| 3,913,005 | 10/1975 | Cook | 373/146 |
| 4,238,637 | 12/1980 | Bingen et al. | 373/146 |
| 5,109,389 | 4/1992 | Stenzel | 373/156 |

FOREIGN PATENT DOCUMENTS

| | | |
|---|---|---|
| 0 403 138 | 12/1989 | European Pat. Off. . |
| 51-39505 | 4/1976 | Japan . |
| 6-036865 | 10/1994 | Japan . |

*Primary Examiner*—Tu Ba Hoang
*Attorney, Agent, or Firm*—Shook, Hardy & Bacon L.L.P.

[57] ABSTRACT

In a process for the operation of coreless induction melting and/or holding furnaces—in which there results in the melting operation at a relatively high induction frequency (as compared to the mains frequency) a slight stirring motion in the melt, but a high degree of effectiveness for the melting process, and in the melting and holding operation at a correspondingly lower induction frequency there results a greater stirring motion in the melt, but a lower degree of effectiveness for the melting process—it is provided that at least one capacitor switched in parallel to the induction coil(s) is provided, which capacitor(s), together with the induction coil(s), form a resonant circuit; and that in the transition from the melting operation with slight stirring motion in the melt to the melting or holding operation with greater stirring motion, or in the reverse transition, the capacitor capacitance and/or the inductance present in the resonant circuit is increased, or as the case may be, decreased.

13 Claims, 3 Drawing Sheets

Figure 1:
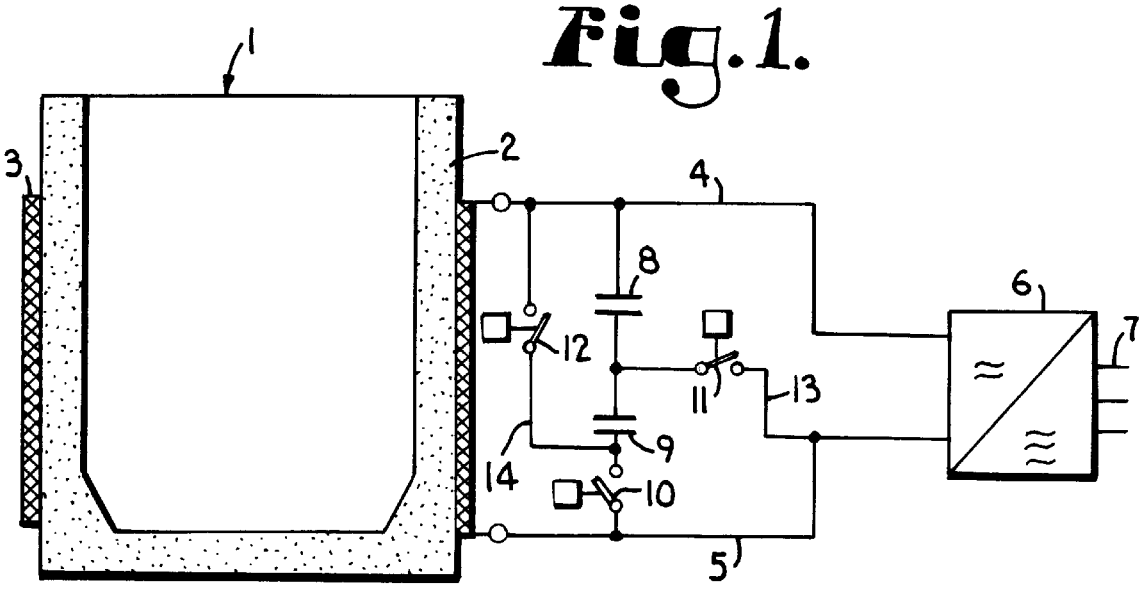

PROCESS FOR THE OPERATION OF CORELESS INDUCTION MELTING FURNACES OR HOLDING FURNANCES AND AN ELECTRICAL SWITCHING UNIT SUITABLE FOR THE SAME

This application is a national filing under 35 U.S.C. § 371 and priority is claimed herein pursuant to 37 C.F.R. § 1.78 and 35 U.S.C. § 119 from copending International Application No. PCT/DE95/00175 filed on Feb. 10, 1995 and which designated the United States of America at the time of filing.

DESCRIPTION

The present invention relates to a process for the operation of coreless induction smelting or holding furnaces, in which in melting operation, at an induction frequency of ≧100 Hz, there results a slight stirring motion in the melt, and in the melting or holding operation, at an induction frequency lowered by a maximum of 50%, but always ≧50 Hz, there results a greater stirring motion in the melt, as well as to an electrical switching unit for coreless induction melting and holding furnaces with an induction frequency in the range from mains frequency to medium frequency which exhibit at least one single- or multi-part induction coil positioned around a furnace crucible, as well as an electrical voltage supply device with a frequency transformer or converter.

Known from DE-PS 27 48 136 is a coreless induction crucible furnace that can be operated both with the mains frequency and with a higher frequency. This kind of furnace is chiefly operated with a medium frequency in order to rapidly melt the metal introduced in solid condition to the melting crucible. If, on the other hand, the already molten metal is vigorously stirred and slag or alloy treatments are performed with the melt, a lower frequency, e.g., the mains frequency, is primarily used.

A disadvantage of this known induction melting and holding furnace, and the process used to operate it, rests in the fact that two different power mains must be available to perform the assigned function, specifically, operation in two frequency ranges. The expense in terms of apparatus is therefore high, since practically two separate switching facilities must be employed.

Also requiring two supply facilities with different frequencies is the solution according to British patent no. 508 255 (FIG. 9). Here, an induction coil consisting of two partial coils is simultaneously attached to one feed device of lower frequency and one of higher frequency. In addition to the high expense associated with the subject matter of the first referenced patent, the British patent has a further disadvantage in that each mains must be protected with a special filter so that the frequency of either mains does react negatively on the other.

The goal of the present invention, therefore, is to indicate a process for the operation of a furnace of the generic type in which only a slight degree of increased technical expense makes operation with several frequencies possible, where the additional expenses are cost-effective and can be realized in a small space.

This goal is achieved by the process according to the invention in that at least one capacitor, switched in parallel with the induction coil(s), is provided which, together with the induction coil(s), forms an electrical resonant circuit, and in that during the transition from melting operation, involving only slight stirring movement in the melt, to the melting or holding operation, involving a greater degree of stirring movement, or during the reverse transition, the capacitor capacitance and/or the inductance present in the resonant circuit are increased or decreased.

Furthermore, the process according to the invention may provide that the capacitance and/or the inductance of the resonant circuit can be increased or decreased by at least ⅓ its given total.

It has proven to be expedient and sufficient to increase the capacitance or the inductance by at least the indicated amount.

An even more intensive melting bath mixture can be obtained by increasing or reducing the capacitance and/or inductance of the resonant circuit by twice its total value.

Secondary claims 4 to 6 contain particularly advantageous methods for implementing the process according to the invention. It has proven to be particularly economical to switch on only the upper part of the induction coil—particularly the upper half—to achieve intensive mixture of the metal melt in the area of the liquid level of the bath and to direct the available capacitor power, as designed for the entire furnace coil, to this partial coil.

The present invention is also based on the problem of elaborating a coreless induction melting furnace and/or holding furnace of the type initially described in such a way that it can be fed in alternating fashion with different frequencies, while permitting the technical expenditure to be small.

The problem is solved in an induction melting and/or holding furnace of the type according to the invention in that at least one capacitor is provided within the electrical conducting path between the induction coil(s) and the frequency converter, where the capacitor(s) for the induction coil(s) are switched in parallel and together with the latter form an electrical resonant circuit, whose natural frequency is adjusted to the given inductance frequency, and where electrical switching elements are provided within the indicated conducting path by means of which the capacitance and/or the inductance of the resonant circuit, and thus the latter's natural frequency, can be adjusted in stepped fashion.

These measures, which require only limited technical expenditure, permit the induction furnace to be charged with different frequencies despite only one power supply device. The solution according to the invention has a further advantage in that it can be cost-effectively realized with a savings in space.

The invention may further provide that the switching elements are designed in such a way that, when actuated, capacitors and or/or induction coils that are first switched in series are then switched in parallel, and vice versa.

Here, either the individual capacitors or induction coils can be switched in the themselves in the indicated manner, or this kind of changeover for capacitors and induction coils can be performed simultaneously. For the changeover of two equally large capacitors from series to parallel switching, the natural frequency of the resonant circuit can accordingly be increased or decreased by a factor of 2. This change in frequency can be further increased either by the use of several capacitors or induction coils or by switching both structural units simultaneously.

The switching unit according to the invention may further provide that at least two switching elements can be locked one relative to the other by means of an electrical or electro-mechanical locking device.

This kind of locking device is particularly attractive when several capacitors and/or induction coils are provided which require a changeover with several switching elements and not all switching elements can be actuated simultaneously.

The switching unit according to the invention can furthermore be designed in such a way that the induction coils are separated by means of at least one tap.

This embodiment represents an alternative to two separate induction coils.

The switching unit according to the invention can also be elaborated in such a way that only one part of windings of the induction coil(s) is fed with the distribution voltage.

This operating mode can also be controlled by switching elements, which, for example, provide for a voltage division for several capacitors which are switched in series and together are positioned in parallel to the induction coil(s). This partial feed particularly serves to save energy in the holding operation of the induction furnace.

A particularly advantageous embodiment of the switching unit according to the invention provides that the part of the windings of the induction coil(s) lying in the vicinity of the melting bath surface is fed with the distribution voltage.

This operating mode is particularly suitable in the stirring and holding operation of the induction furnace, since the efficiency of energy transmission to the melt is greatest in the area of the melting bath surface.

Instead of dividing the induction coil by means of a tap, the switching unit according to the invention can be laid out in such a way that at least two electrically separated induction coil parts are provided and that at least the upper induction coil part is fed with the entire capacitance of the capacitors.

In the transition from melting operation with a higher frequency, i.e., with slight stirring action in the melt, to melting or holding operation with a greater stirring action, the capacitor power is increased by the amount necessary to achieve an optimal degree of effectiveness. In the process, the resonant circuit of the induction furnace is changed, i.e., the oscillating frequency of the resonant circuit is lowered. Thus overall the frequency of the furnace feed current can be lowered in simple fashion and as desired, and the stirring action can be increased.

In the following portion of the description the process and switching unit according to the invention are described in greater detail on the basis of the exemplary embodiments shown in the figures.

Figure 2:
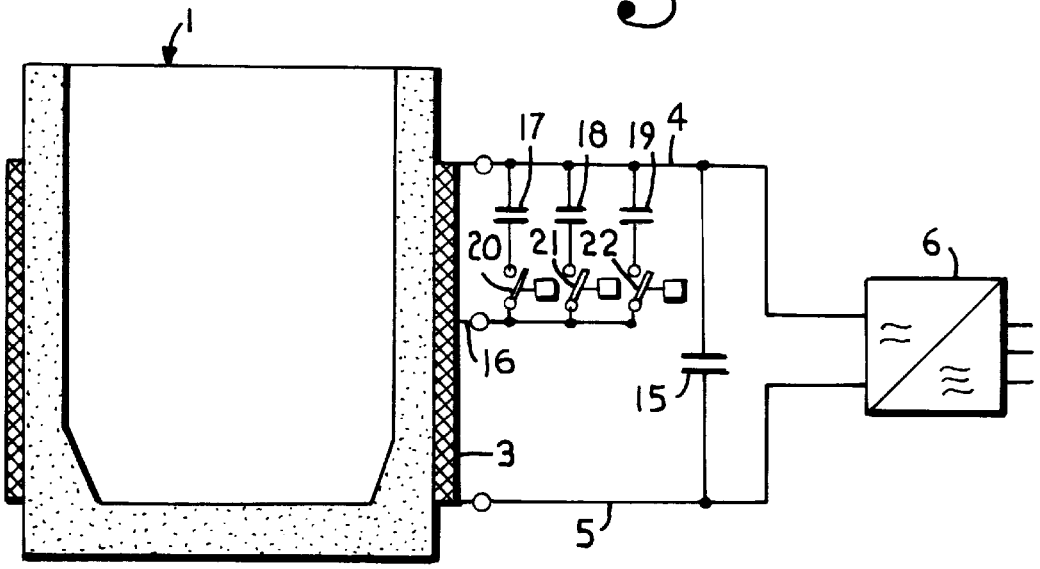
Figure 3:
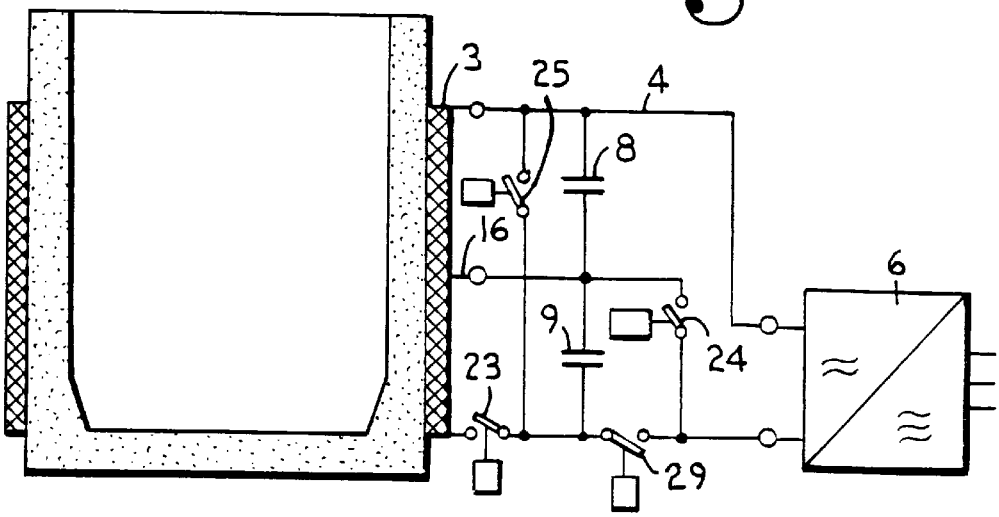
Figure 4:
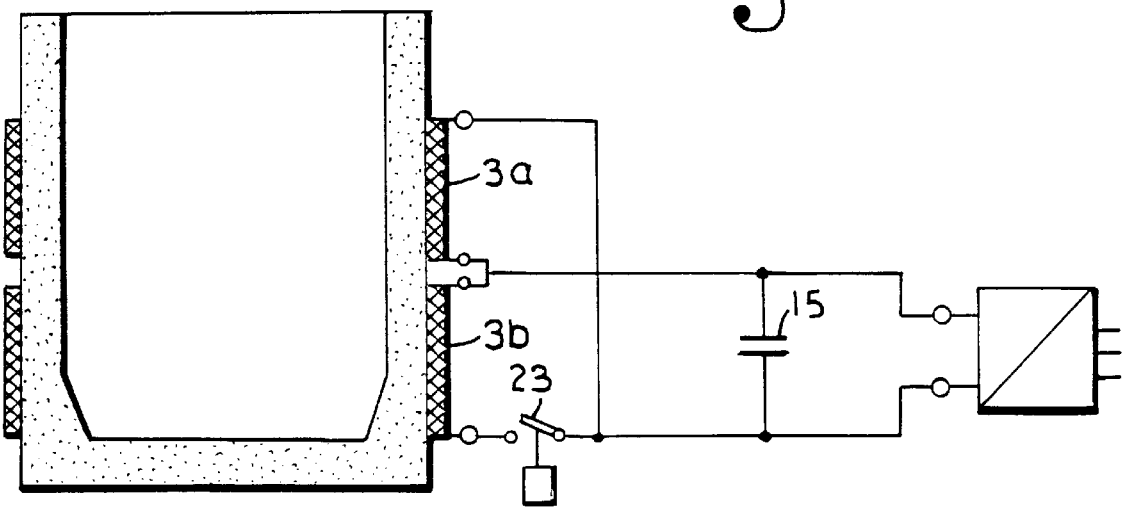
Figure 5:
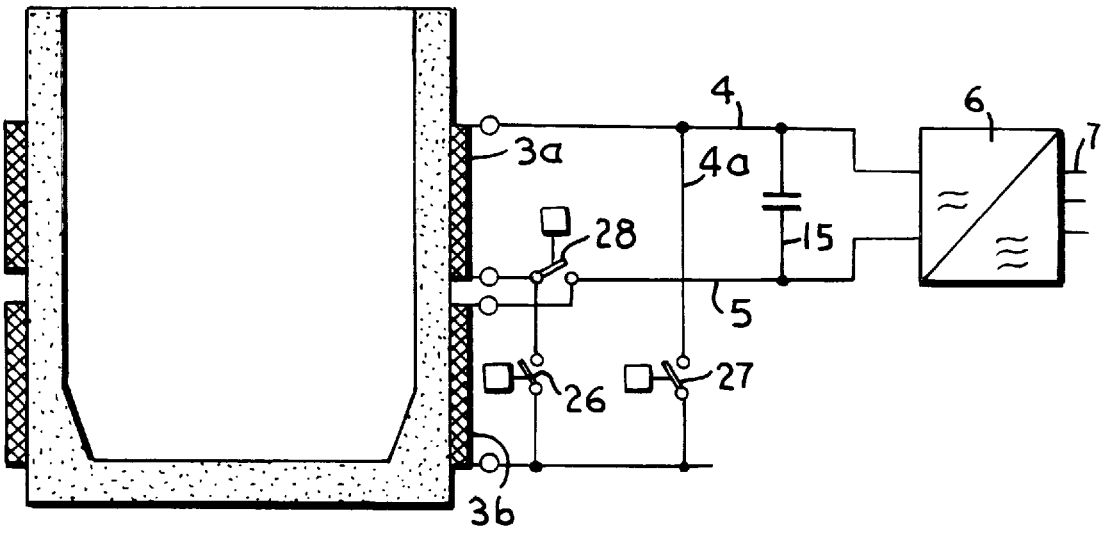

Shown are:

FIG. 1 an induction crucible furnace with a switching unit according to the invention, by means of which it is possible lower the induction frequency by increasing the capacitor capacitance for the entire coil FIG. 2 a depiction following FIG. 1, in which the induction frequency is reduced by switching on capacitor power in the upper coil part alone FIG. 3 a depiction following FIGS. 1 and 2, in which the induction frequency is dropped by increasing the capacitor capacitance and the inductance of the furnace coil FIG. 4 a depiction following FIGS. 1–3, in which the induction frequency is dropped by increasing the inductance of the coil FIG. 5 a depiction following FIGS. 1–4, in which the induction frequency is lowered by increasing the inductance in a coil divided into two parts.

FIG. 1 schematically depicts a coreless induction crucible furnace 1 with an induction coil 3 surrounding the furnace crucible 2. The induction coil 3 is attached to a three-phase mains by way of lines 4, 5 and a frequency transformer or resonant circuit converter 6. In addition, capacitors 8, 9 are provided, which can be switched in series—and parallel to the induction coil—to lines 4, 5 by means of a switch 10. To increase the capacitance of the capacitors 8, 9 by a factor of four, and thus to decrease the frequency by half, switches 11, 12 and lines 13, 14 permit the capacitors 8, 9 to be switched in such a way that the capacitors 8, 9 lie electrically parallel to each other, but also lie parallel overall to the induction coil 3.

In the exemplary embodiment according to FIG. 2, the induction coil 3 of the coreless induction crucible furnace 1 is attached to the resonant circuit converter 6 by means of lines 4, 5. Positioned between lines 4, 5 is a capacitor 15. At about half its height the induction coil 3 has a tap 16, between which tap and line 4 additional capacitors 17, 18, 19 may be switched with switches 20, 21, 22. In this case, the operating frequency can be dropped merely in the upper half of the induction coil, or the stirring motion and the power increased only in the upper furnace half of the melt.

In the example shown in FIG. 3, the induction coil 3 also has centrally positioned tap 16. The induction coil 3 can be attached to the resonant circuit converter 6 by means of lines 4, 5. The capacitors 8, 9 are switched in series between lines 4, 5. With actuation of the switch 23 and a further switch 25—where a blocking device prevents switch 23 from being closed— the capacitors are connected to the upper half of the induction coil 3 in parallel switching. Switches 24 and 29 are provided for proper switching between operating phases. In this case, both the capacitance of the capacitors and the inductance of the induction coil are increased.

FIG. 4 shows an application of the invention in which the inductance is doubled in an induction coil divided into two parts 3*a*, 3*b*. In normal melting operation the switch 23 is closed, and thus the two coil parts 3*a*, 3*b* are fed with the distribution voltage. In the state depicted—that is, with switch 23 not shut—only coil part 3*a* is switched on. In this case, the operating frequency is reduced by a factor of $\sqrt{2}$.

FIG. 5 shows a coreless induction crucible furnace in which partial coils 3*a*, 3*b* are provided, which are attached to the three-phase mains 7 by means of lines 4, 5 and the resonant circuit converter 6. A capacitor 15 is inserted parallel to the partial coils 3*a*, 3*b*. By closing the switch 26 it is possible to feed the two partial coils 3*a*, 3*b* from the resonant circuit converter 6 in parallel switching. In order to lower by about 50% the frequency of the voltage at the two partial coils 3*a*, 3*b*, the partial coils 3*a*, 3*b* are connected in series to the resonant circuit converter 6 by switches 27, 28. Here also the switch 26 and switches 27, 28 are locked with respect to each other, such that switches 27, 28 can only be closed when switch 26 is open.

I claim:

1. A process for operating a coreless induction furnace including an induction coil and a capacitor arrangement comprising first and second capacitors, said capacitor arrangement being switched in parallel with said induction coil, said induction coil and said capacitor arrangement together forming an electrical resonant circuit, in which furnace, (1) during a first melting operation conducted at an induction frequency of at least 100 Hz, a slight stirring movement takes place in the melt, and (2) during a second melting or holding operation conducted at an induction frequency less than 100 Hz but not less than 50 Hz, a greater stirring movement takes place in the melt, said process comprising:

causing said first and second capacitors of said furnace to operate in series during said first melting operation; and causing said first and second capacitors to operate in parallel to increase capacitor capacitance during said second melting or holding operation.

2. A process as set forth in claim 1, wherein the melt in the furnace has an upper surface, wherein said coil has a plurality of windings which are arranged in a vertical stack, and wherein only windings which are in the vicinity of said surface are electrically energized during the second melting or holding operation.

3. A process for operating a coreless induction furnace having an induction coil comprising first and second coil portions and a capacitor, said capacitor being switched in parallel with at least one portion of said induction coil, said induction coil and said capacitor together forming an electrical resonant circuit, in which furnace, (1) during a first melting operation conducted at an induction frequency of at least 100 Hz, a slight stirring movement takes place in the melt, and (2) during a second melting or holding operation conducted at an induction frequency less than 100 Hz but not less than 50 Hz, a greater stirring movement takes place in the melt, said process comprising:

causing said first and second coil portions of said furnace to operate in parallel during said first melting operation; and causing said first and second coil portions to operate in series to increase inductance during said second melting or holding operation.

4. A process as set forth in claim 3, wherein the melt in the furnace has an upper surface, wherein said coil has a plurality of windings which are arranged in a vertical stack, and wherein only windings which are in the vicinity of said surface are electrically energized during the second melting or holding operation.

5. A process as set forth in claim 3, wherein said coil portions are arranged in a vertical stack with the first coil portion disposed above the second coil portion, and wherein only the first coil portion is electrically energized during the second melting or holding operation.

6. Electrical switching apparatus for a coreless induction furnace which includes a crucible that may be operated at different induction frequencies, said apparatus comprising:

a frequency controller;

an induction coil positioned around the crucible;

a capacitor arrangement which is located within an electrical conducting path between the induction coil and the frequency controller, said capacitor arrangement being electrically connected in parallel with said induction coil and comprising first and second capacitors, said induction coil and said capacitor arrangement together forming an electrical resonant circuit; and electrical circuitry electrically interconnecting said controller, said induction coil and said capacitor arrangement for adjusting a natural frequency of said electrical resonant circuit by connecting said first and second capacitors of said furnace in series during one operating phase of the furnace at a first operating frequency and by connecting said first and second capacitors in parallel to increase capacitor capacitance during a second operating phase of the furnace at a second operating frequency lower than said first frequency.

7. Electrical switching apparatus as set forth in claim 6, wherein said circuitry includes a plurality of electrical switches and at least two of said switches are locked together for simultaneous actuation.

8. Electrical switching apparatus as set forth in claim 6, wherein a melt in the crucible has an upper surface, wherein said coil has a plurality of windings which are arranged in a vertical stack, and wherein said circuitry includes circuit elements electrically connecting said windings so that only windings which are in the vicinity of said surface are electrically energized during the second operating phase.

9. Electrical switching apparatus for a coreless induction furnace which includes a crucible that may be operated at different induction frequencies, said apparatus comprising:

a frequency controller;

an induction coil comprising first and second coil portions positioned around the crucible;

a capacitor which is located within an electrical conducting path between the induction coil and the frequency controller, said capacitor being electrically connected in parallel with at least one portion of said induction coil, said induction coil and said capacitor together forming an electrical resonant circuit; and electrical circuitry electrically interconnecting said controller, said induction coil and said capacitor for adjusting a natural frequency of said electrical resonant circuit by electrically connecting said first and second coil portions in parallel during one operating phase of the furnace at a first operating frequency and by connecting said first and second coil portions in series to increase inductance or disconnecting a supply of current to at least one of said coil portions during a second operating phase of the furnace at a second operating frequency lower than said first frequency.

10. Electrical switching apparatus as set forth in claim 9, wherein said circuitry includes a plurality of electrical switches and at least two of said switches are locked together for simultaneous actuation.

11. Electrical switching apparatus as set forth in claim 9, wherein a melt in the crucible has an upper surface, wherein said coil has a plurality of windings which are arranged in a vertical stack, and wherein said circuitry includes circuit elements electrically connecting said windings so that only windings which are in the vicinity of said surface are electrically energized during the second operation phase.

12. Electrical switching apparatus as set forth in claim 9, wherein said coil portions are arranged in a vertical stack with the first coil portion disposed above the second coil portion, and wherein a tap is provided in said crucible located between said coil portions.

13. A process for operating a coreless induction furnace having an induction coil comprising first and second coil portions and a capacitor, said capacitor being switched in parallel with at least one portion of said induction coil, said induction coil and said capacitor together forming an electrical resonant circuit, in which furnace, (1) during a first melting operation conducted at an induction frequency of at least 100 Hz, a slight stirring movement takes place in the melt, and (2) during a second melting or holding operation conducted at an induction frequency less than 100 Hz but not less than 50 Hz, a greater stirring movement takes place in the melt, said process comprising:

causing said first and second coil portions of said furnace to operate in parallel during said first melting operation; and discontinuing a supply of current to at least one of said coil portions during said second melting or holding operation.

* * * * *